United States Patent [19]

Suzuki et al.

[11] 4,344,252

[45] Aug. 17, 1982

[54] GARAGE DOOR OPERATION CONTROL APPARATUS

[75] Inventors: Mitsuo Suzuki; Takeshi Tokunaga; Seiji Yonekura; Shigeru Matsuoka; Kenji Nakamura, all of Hitachi, Japan

[73] Assignee: Hitachi, Ltd., Tokyo, Japan

[21] Appl. No.: 134,867

[22] Filed: Mar. 28, 1980

[30] Foreign Application Priority Data

Feb. 21, 1979 [JP] Japan ..... 54-19392

[51] Int. Cl.[3] ..... E05F 11/00

[52] U.S. Cl. ..... 49/199; 49/28; 318/266

[58] Field of Search ..... 49/26, 28, 199, 200, 49/139; 318/466, 467, 468, 265, 266

[56] References Cited

U.S. PATENT DOCUMENTS

| | | | |
|---|---|---|---|
| 3,694,664 | 9/1972 | Carli | 48/28 X |
| 3,764,875 | 10/1973 | Harris | 318/266 |
| 4,010,408 | 3/1977 | Bailey | 318/266 |
| 4,055,023 | 10/1977 | Gatland et al. | 49/28 |
| 4,263,536 | 4/1981 | Lee et al. | 318/468 |

*Primary Examiner*—Kenneth Downey

*Attorney, Agent, or Firm*—Craig and Antonelli

[57] ABSTRACT

A garage door operation control apparatus comprises a disc rotatable in interlocked relation with a door driving system, which disc actuates an upper limit switch and a lower limit switch at the door upper and lower limit positions respectively. The interlocked relation of the driving system and the disc may be cancelled thereby to adjust the responsive position of the limit switches.

10 Claims, 15 Drawing Figures

GARAGE DOOR OPERATION CONTROL APPARATUS

The present invention relates to a garage door operation control apparatus, or more in particular to a garage door operation control apparatus comprising limit switches actuated at the upper and lower limit positions of the door respectively.

A conventional device for opening and closing a garage door by a motor drive system has been suggested. This system includes a motor which is connected to a power supply through a relay circuit controlled by a push button switch or a radio control switch for issuing a command to operate the relay circuit and thereby drive the door in the desired direction. A door operation control apparatus having such a motor drive system is disclosed in U.S. Pat. No. 3,178,627 issued to Richard D. Houk and patented on Apr. 13, 1965 and U.S. Pat. No. 3,906,348 issued to Colin B. Willmatt and patented on Sept. 16, 1975. In mounting a door operating device at the entrance of a garage, a lower limit stop position and an upper limit stop position of the door is required to be determined in accordance with the construction, the length of the door of the garage and other factors. In the case of a snowfall or freezing at the entrance of the garage, the door lower limit stop position is required to be corrected or reset. In such a case, a door stop position control device for the door operating device mounted at a high position on or near the garage ceiling must be handled on a step ladder or the like. In any case, both hands are required for setting the stop position. Further, the dangerous and rather complicated nature of this work inevitably leads to instability and unsafety of the worker. Further, in any conventional type of control devices, the work is performed on or in the vicinity of the driving system, and therefore, if the driving system is driven by erroneous operation by children or other causes, serious personal damage may result. Furthermore, the setting of the door stop position, especially, the door lower limit stop position requires a fine adjustment. For this purpose, the setting, operation, confirmation and resetting must be repeated many times in the conventional control systems. Each time such a job is performed, troublesome processes of climbing up and down the stepladder, fastening the screws and the like are required.

Accordingly, it is an object of the present invention to provide a garage door operation control apparatus in which the actuating position of the stop position limit switches for detecting a door stop position is easily set.

According to the present invention, there is provided a garage door operation control apparatus comprising a driving system including a motor for opening and closing the door, an operating member moved in proportion to the amount of operation of the driving system, the operating member being connected to the driving system through transmission means, and a door stop position control switch operated by the operating member at a predetermined door stop position, wherein the transmission means includes means for releasing the interlocked relation of the driving system and the operating member, and the operating member is supported in such a manner that, when released from the interlocked condition with the driving system, it is movable to a position for operating the door stop position control switch.

The above and other objects, features and advantages will be made apparent by the detailed description taken in conjunction with the accompanying drawings, in which.

Figure 1:
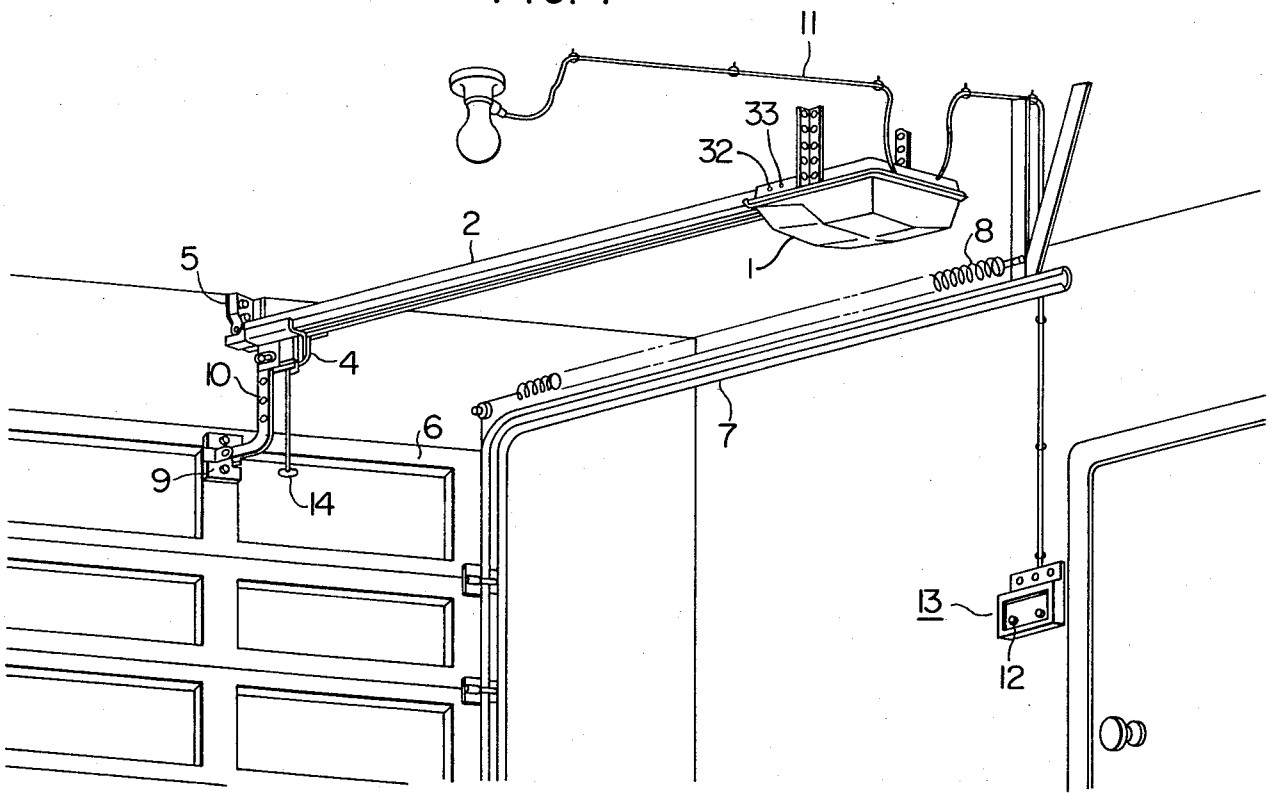
FIG. 1 is a perspective view of the whole structure of a door operating device according to the present invention.

The whole construction of a garage door operating device according to the present invention is shown in FIGS. 1 to 4. The essential parts of the device comprise a driving system including a drive mechanism 1, a rail 2 connected with the drive mechanism 1, a roller chain 3 guided along the rail 2 by being driven by the drive mechanism 1, and a trolley 4 engaged with the roller chain 3 and adapted to be moved horizontally. The drive mechanism 1 is hung from the ceiling of the garage by a hanger, and an end of the rail 2 is secured to part of the garage by a header bracket 5. A garage door 6, on the other hand, is generally divided into several parts coupled to each other and is opened and closed along door rail 7 on both sides thereof. The weight of the garage door 6 is balanced with a door balance spring 8 and is capable of being operated manually. A door bracket 9 is secured to the garage door 6. The door bracket 9 is rotatably coupled to the trolley 4 through a door arm 10. Thus the garage door 6 is closed or opened by being moved along the door rail 7 in an interlocked relation with the roller chain 3 actuated by the driving force of the drive mechanism 1 and the trolley 4 horizontally moved along the rail 2 by actuation of the roller chain 3. Power is supplied to the drive mechanism 1 through a power cable 11.

A command for operating the drive mechanism 1 is issued to the body 1 by depressing a push button switch 12 mounted on the wall of the garage or from a control 13 housing a receiver for receiving a signal in the form of electric wave or the like. Should the garage door operating device be rendered inoperative by a power failure or an accident, a releasing string 14 decouples the roller chain 3 and the trolley 4, thus making the garage door 6 ready for manual operation.

Figure 2:
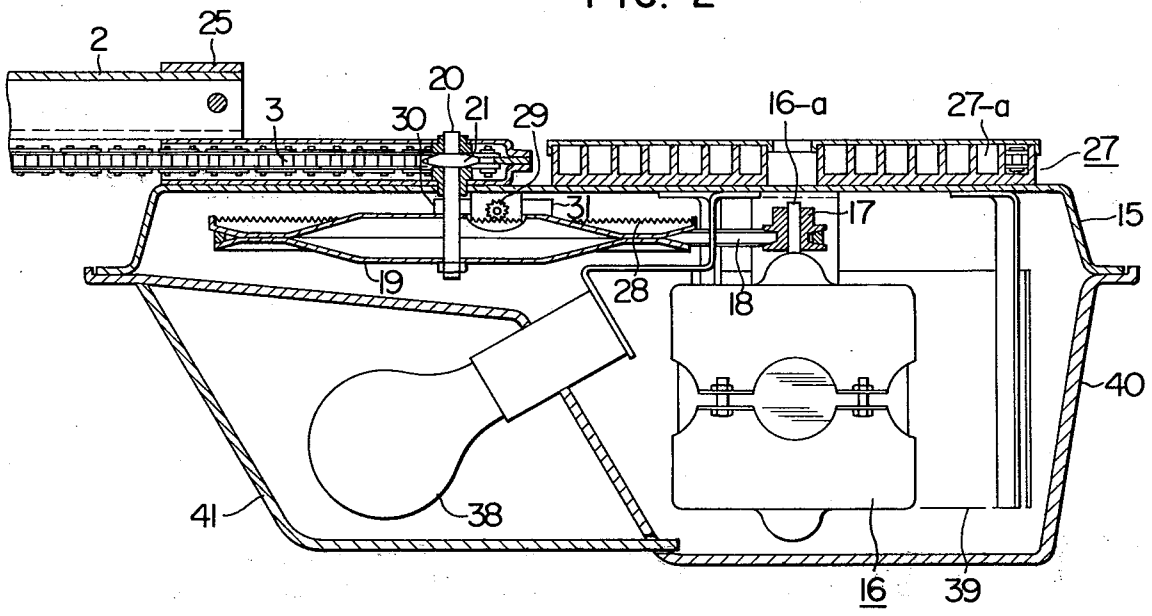
FIG. 2 is a longitudinal sectional view of the body of the device.
Figure 3:
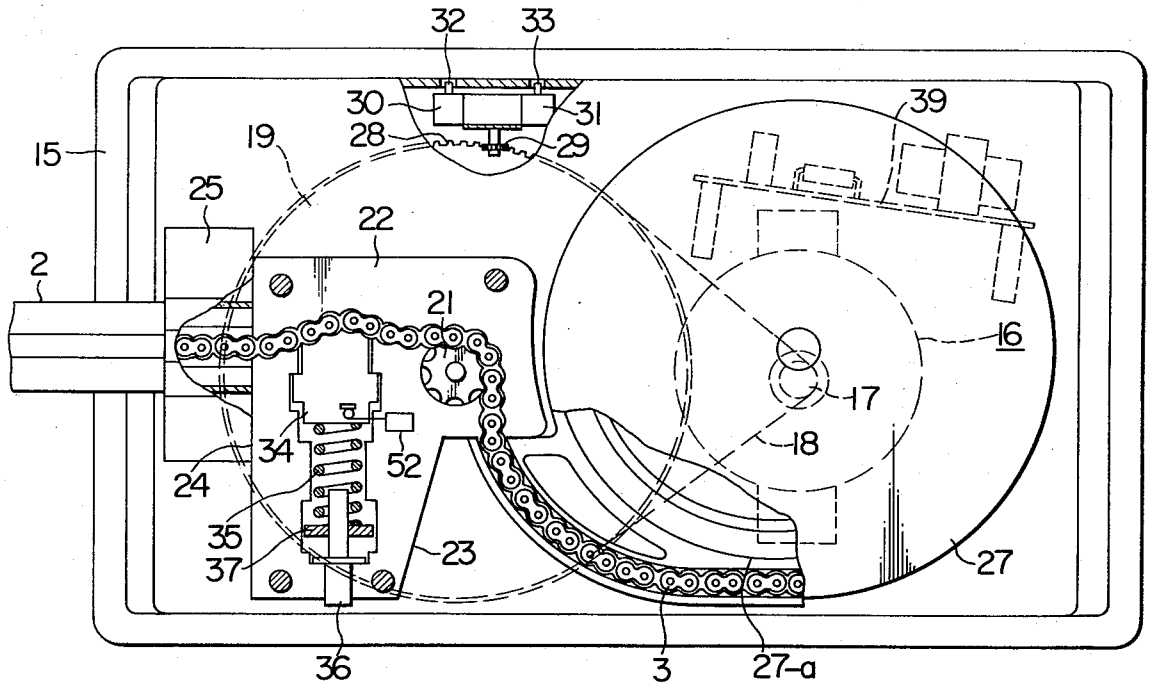
FIG. 3 is a partially cut-away plan view of the body.

The construction of the body 1 of the garage door operating device will be explained with reference to FIGS. 2 and 3. FIG. 2 is a longitudinal sectional view and FIG. 3 a partially cut-away top plan view of the drive mechanism 1. The turning effort of a motor 16 secured to the lower side of the frame 15 is transmitted to a motor pulley 17 secured to a motor shaft 16-*a*, a V-belt 18 and a large pulley 19. Further, the turning effort of the large pulley 19 is transmitted to a sprocket 21 through a sprocket shaft 20.

The sprocket 21 is engaged with the roller chain 3. The rollers of the roller chain 3 are guided by a chain guide (A) 22, a chain guide (B) 23 and a chain guide (C) 24 from both sides thereof within the frame 15. The rail 2 is secured to the frame 15 by a rail securing metal member 25 without any difference in level or a gap with a groove formed by the chain guide (A) 22 and the chain guide (C) 24. The roller chain 3 is guided by the rail 2.

The roller chain 3 taken up by the sprocket 21 is contained in chain containing groove 27-*a* of a chain containing case 27 secured without any difference in level or a gap with the groove formed by the chain guide (A) 22 and the chain guide (B) 23.

In this construction, the rotation of the motor 16 rotates the sprocket 21, so that the roller chain 3 is reciprocated along the rail 2.

Next, a door stop position control mechanism for limiting the horizontal movement of the trolley 4, i.e., the upper and lower limits of the operation of the garage door 6 explained with reference to FIG. 1 will be described. The amount of movement of the roller chain 3 is converted into the amount of movement of a pulley rack 28 provided on the outer periphery of the large pulley 19 rotated at the same rotational speed as the sprocket 21. The amount of movement of the pulley rack 28 is transmitted to an upper limit switch 30 and a lower limit switch 31 through a pinion 29 in mesh with the pulley rack 28.

The upper limit switch 30 and the lower limit switch 31 have an upper limit adjusting knob 32 and a lower limit adjusting knob 33 respectively whereby the upper limit point and the lower limit point are freely adjustable from outside of the frame 15.

In the case where the garage door encounters an obstruction during the downward motion thereof, it should be immediately detected and the door operation should preferably be reversed, i.e., it must be moved upward for safety's sake. If the garage door strikes an obstruction during the upward motion thereof, on the other hand, it should be detected and the door should be preferably stopped immediately for safety's sake. The above-mentioned obstruction detecting mechanism will be described below.

Part of the chain guide groove formed by the chain guide (A) 22, the chain guide (B) 23 and the chain guide (C) 24 is curved. An obstruction detecting device 34 is provided which is driven by the compressive force applied to the roller chain by the downward door motion or the tensile force applied to the roller chain 3 by the upward door motion. The compressive force of the obstruction detecting spring 35 for limiting the operation of the obstruction detecting device 34 is changed by moving the spring holding plate 37 by turning the obstruction-exerted force adjusting screw 36. Also, by the operation of the obstruction detecting switch 52 which is turned on and off in response to the movement of the obstruction detecting device 34, such an obstruction as mentioned above is detected, so that the door is reversed into upward motion from downward motion, whereas it is stopped if it is in upward motion.

A lamp 38 is provided for illuminating the inside of the garage, which lamp 38 is adapted to be turned on or off in response to the movement of the garage door. Further, a controller 39 for controlling the motor 16 and the lamp 38 is secured within the frame 15. A body cover 40 and a lamp cover 41 cover the motor 16, the large pulley 19 and the lamp 38. The lamp cover 41 is translucent and allows the light of the lamp 38 to pass therethrough, thus brightly illuminating the inside of the garage. The foregoing is the description of the construction of the body of the garage door operating device. Next, the rail and the trolley will be explained below with reference to FIG. 4.

Figure 4:
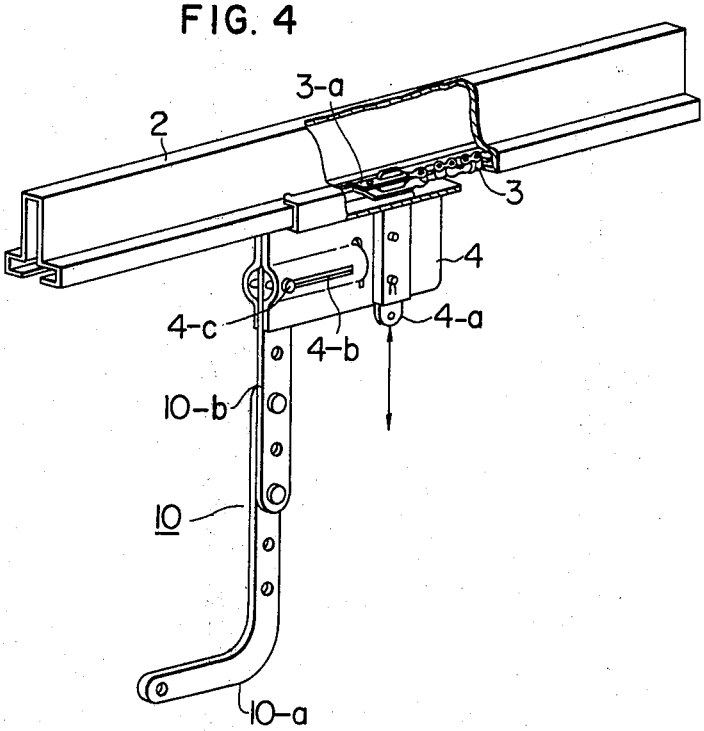
FIG. 4 is a perspective view showing a trolley engaged with a rail.

The rail 2 is formed of a thin iron plate or a plastic plate and is used to slidably guide the trolley 4 along the outer periphery thereof. The rail 2 holds the roller chain 3 thereby to reciprocate the roller chain 3 in a straight line. The trolley 4 and the roller chain 3 are coupled to each other in such a way that a connecting metal member 4-*a* is inserted into a slot formed in the roller chain attachment 3-*a* secured to the end of the roller chain 3 and guided in the same manner as the roller chain 3. The connecting metal member 4-*a* is slidable within the trolley 4 and is normally held up by the force of a spring or the like, thus coupling the trolley 4 with the roller chain 3. In the event of a power failure or other accident when the door is required to be operated by human power by separating the garage door operating device from the door, the connecting metal 4-*a* is pulled down and separated from the roller chain attachment 3-*a*. The door arm 10 for transmitting the operation of the trolley 4 is comprised of an L-shaped door arm portion 10-*a* and a straight door arm portion 10-*b* which are coupled with the length thereof determined freely depending on the positional relation between the door and the rail. An end of the door arm 10 is connected to the trolley 4, and the other end thereof is connected to the door 6 through the door bracket 9 shown in FIG. 1. The door arm 10 and the trolley 4 are connected with each other in such a manner that a pin 4-*c* is inserted into the slot 4-*b* of the trolley 4. The pin 4-*c* is normally kept pressed as shown in FIG. 4. This is for the purpose of absorbing the shock which will occur if the door collides with an obstruction while moving down.

Further, some action must be taken to prevent the reversing of the door downward movement by erroneous obstruction detection in the presence of a small item such as a water hose or the raising of the floor surface by snow, ice or the like. Specifically, up to the height of two inches from the floor surface, it is necessary that the door movement be not reversed but stopped by detection of an obstruction. In this case, the difference of the amount of movement between the trolley 4 and the door 6 is absorbed by the slot 4-*b*.

Figure 5:
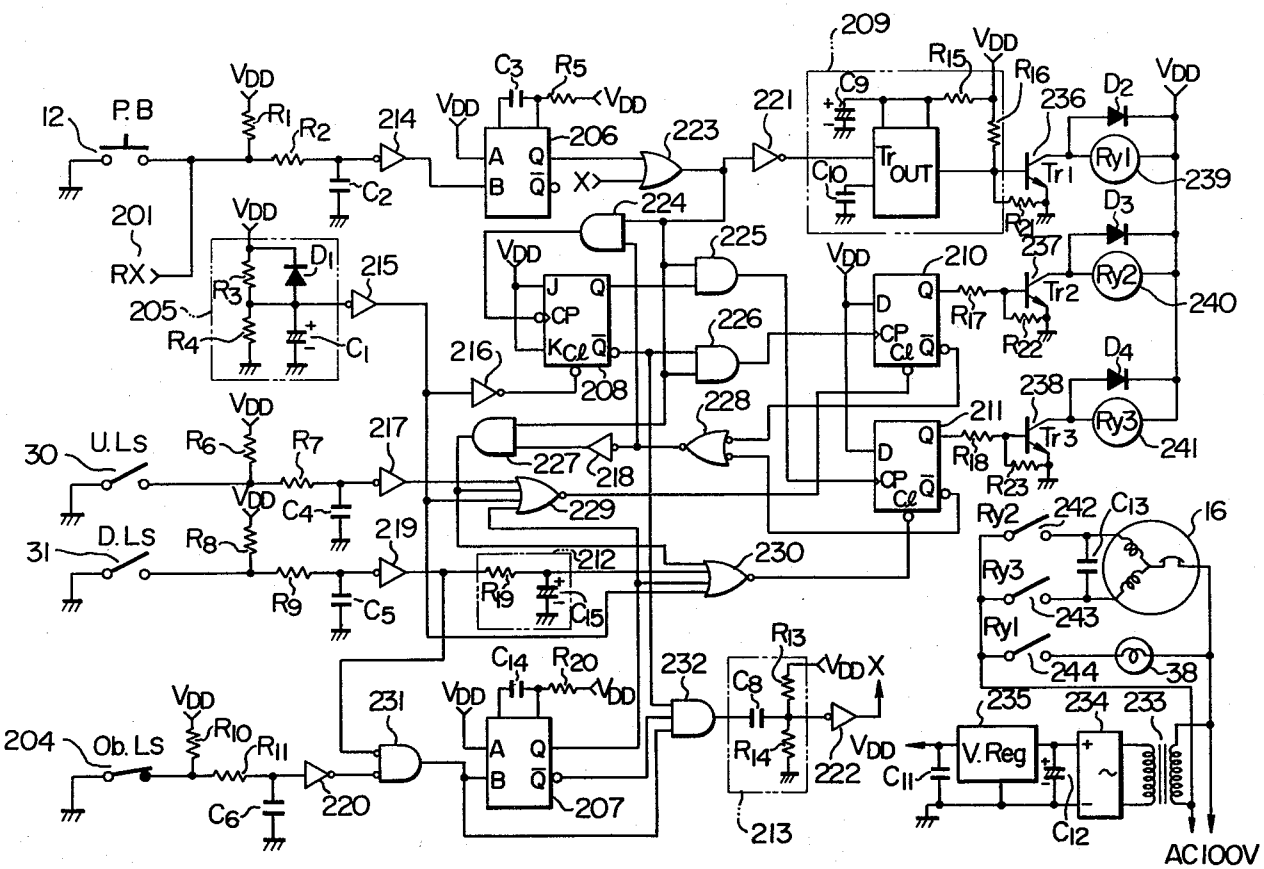
FIG. 5 is a diagram showing a control circuit.

Next, an embodiment of the control apparatus will be described with reference to FIG. 5. Reference numeral 12 shows a push button switch for issuing a door operation command, numeral 201 a relay contact output for issuing a door operation command from a radio receiver, numeral 30 a door upper limit switch, numeral 31 a door lower limit switch, numeral 204 an obstruction detection limit switch, numeral 205 a power supply reset circuit for producing a reset signal at the rise of the power supply, numerals 206 and 207 monostable multivibrators, numeral 208 a J-K master slave flip-flop, numeral 209 a timer circuit using NE555 (of Signetics Corporation), numerals 210 and 211 D-type flip-flops, numeral 212 an integrator circuit, numerals 213 a differentiator circuit, numerals 214 to 222 NOT elements, numeral 223 a 2-input OR element, numerals 224 to 228 2-input AND elements, numerals 229 and 230 4-input NOR elements, numeral 231 a 2-input NOR element, numeral 232 a 3-input AND element, numeral 233 a transformer for control power source, numeral 234 a diode stack, numeral 235 an IC regulator for the control power supply, numerals 236 to 238 relay-driving transistors, numerals 239 to 241 relay coils, numerals 242 to 244 contacts of the relays, numeral 16 a door operating driving motor, and numeral 246 a lamp.

Figure 6:
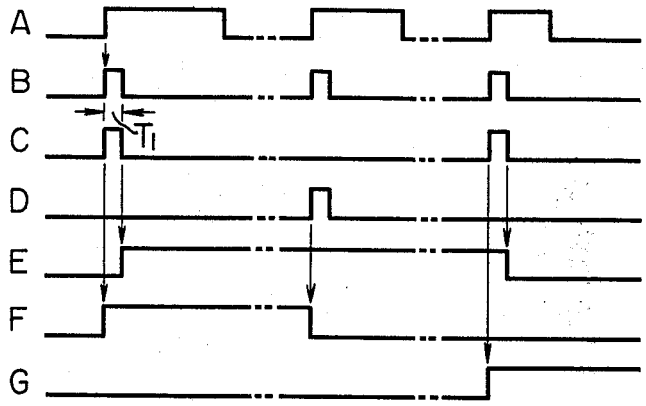
FIGS. 6 and 7 are time charts for explaining the operation.
Figure 7:
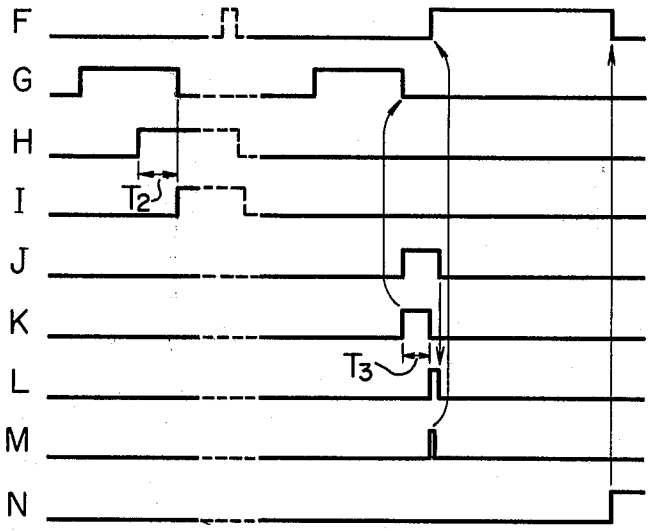

The operation of this circuit will be explained below with reference to the time charts of FIGS. 6 and 7. When power is thrown in this circuit, a control power VDD is supplied from the transformer 233 through the diode stack 234 and the IC regulator 235. The rise of this signal VDD is integrated by the power supply reset circuit 205, so that a reset pulse is produced through the NOT element 215. The reset pulse resets the J-K master slave flip-flop 208 through the NOT element 216, and further resets the D-type flip-flops 210 and 211 through the 4-input NOR elements 229 and 230. Assuming that the relay contact output 201 connected with the push button switch 12 or the radio receiver for issuing a door operation command is turned on and the NOT element 214 produces a signal A, the monostable multivibrator 206 produces a signal B of pulse width T1 at the rise point of the signal A. This signal B is applied to the 2-input OR element 223 and the 2-input AND element 224 thus producing a signal C. The signal C is appied as a clock pulse signal to the J-K master slave flip-flop 208. During the high state of the signal C before reversal of the output signal E, the output of the 2-input AND element 226 is applied as a clock input signal to the flip-flop 210, so that the flip-flop 210 is set, thereby producing a signal F. With this signal as a door up drive command, the transistor 237 excites the relay coil 240 for door upward movement. Thus the relay contact 242 is turned on, thus driving the motor 16 in forward direction. In this way, the motor 16 is started. At the same time, the signal B is applied as a trigger signal to the timer circuit 209 through the NOT element 221. This operation is intended to keep the lamp 38 on for a predetermined length of time after the issue of the door operation command for illuminating the inside of the garage simultaneously with the start of the motor 16. For this purpose, the output of the timer circuit 209 excites the relay coil 239 through the transistor 236, and turns on the relay contact 244. As a result, the lamp 38 is lit for a predetermined length of time. Next, if the upper limit switch 30 is turned on during the production of an up command output, the flip-flop 210 is reset through the NOT element 217 and the 4-input NOR element 229, so that the transistor 237 is turned off, the relay coil 240 is de-energized, the relay contact 242 is turned off, and the motor 16 stops. In the case where an operation command is issued again, that is, the relay contact output 201 from the radio receiver or the push button switch 12 is turned on during the production of the up command, on the other hand, the pulse signal B is produced from the monostable multivibrator 206 as mentioned above, so that an output is produced from the OR element 223. In view of the fact that the flip-flop 210 is set, however, the output of the 2-input AND element 228 is "low", thus prohibiting the output of the 2-input AND element 224. The output of the NOT element 218 is "high", and therefore, the pulse signal B is produced in the form of signal D from the 2-input AND element 227. This signal D is applied through the 4-input NOR element 229 to the flip-flop 210 as a reset signal. In this way, the motor 16 is stopped in this case, too. Upon receipt of another operating command, the output of the 2-output AND element 226 is prohibited in view of the fact that J-K master slave flip-flop 208 is set, so that the signal B is produced from the 2-input AND element 225 and the flip-flop 211 is set, thus producing the signal G. As a result, the transistor 238 is turned on, the door down drive relay coil 241 is excited, the relay contact 242 is turned on, the motor 16 is driven in the reverse direction, and thus the door is moved down. If the lower limit switch 31 is turned on during the downward movement, a signal H is produced from the NOT element 219 and, after being delayed by time T2 at the integrator circuit 212, applied as a reset signal to the flip-flop 211 via the 4-input NOR element 230. In this way, the motor 16 is stopped as in the case of the upper limit switch being turned on during upward movement. Next, the operation of the circuit with the obstruction detection limit switch 204 turned on will be explained.

Assume that the obstruction detection limit switch 204 is turned on when the door is moving up, i.e., when the J-K master slave flip-flop 208 is set, the flip-flop 210 is set and the flip-flop 211 is reset. In view of the fact that the limit switch 204 is closed at contact B, it is turned off. Thus, a "high" signal is produced from the 2-input NOR element 231 through the NOT element 220 and triggers the monostable multivibrator 207. The Q output pulse of the monostable multivibrator 207 resets the flip-flop 210 through the 4-input NOR element 229. At this time, the J-K master slave flip-flop 208 is set and therefore the output of the 4-input AND element 232 is prohibited. Next, assume that the obstruction detection limit switch 204 is turned on during the downward movement, i.e., when the J-K master slave flip-flop 208 is reset, the flip-flop 210 is reset and the flip-flop 211 is set. A signal J is produced from the NOT element 220, and a signal K with pulse width T3 is produced from the monostable multivibrator 207 via the 2-input NOR element 231. This signal K resets the flip-flop 211 through the 4-input NOR element 230. As a result, the motor is stopped and the door stops moving down. Further, at the fall point of the pulse signal K, the output $\overline{Q}$ of the monostable multivibrator 207 rises so that the output of the 3-input AND element 232 becomes "high" and a signal L is produced. This signal L is converted into a signal M through the differentiator circuit 213 and the NOT element 222 and applied to the 2-input OR element 223. In this way, a signal F which is an up command is produced from the above-mentioned control process, with the result that the door moves up and stops in response to an output signal N of the NOT element 217 which is produced from the upper limit switch 30. As will be seen from the foregoing description, when the door detects an obstruction, the movement thereof is immediately stopped if the door is moving up, and it is immediately stopped and begins to move up after the time period of T3 if it is moving down, thus securing the required operating safety. In order to prevent the obstruction detection means from being unduly actuated by a small obstacle such as a stone or a rod located near the door lower limit or the rise of the floor level due to snow in winter, the turning on of the lower limit switch 31 causes the 2-input NOR element 231 to immediately prohibit the operation of the obstruction detection mechanism, while the signal G making up a down command is reset by a signal I with time delay T2 produced from the integrator circuit 212. This control process assures safe door operation without any inconveniences.

Figure 8:
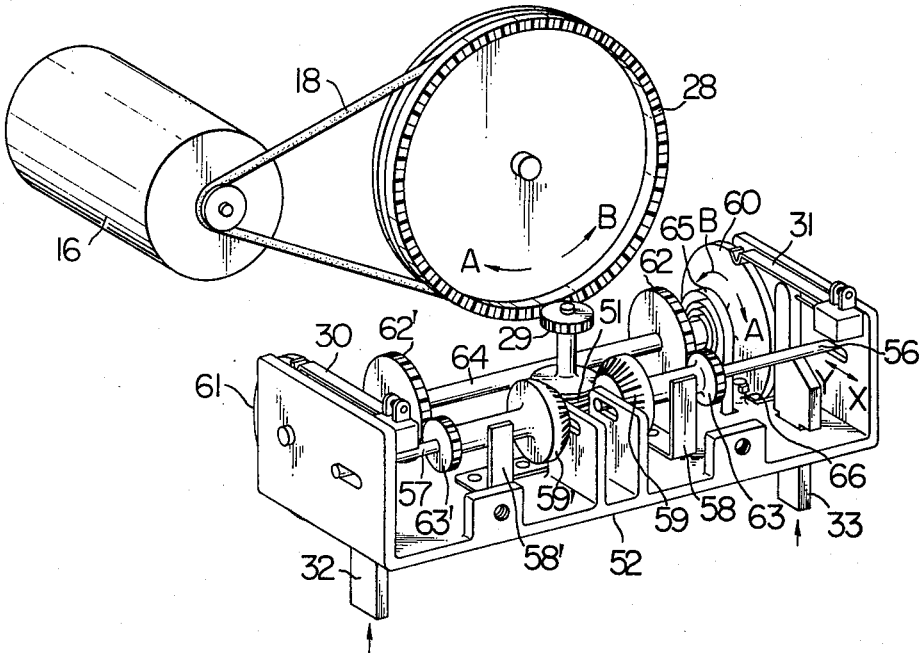
FIG. 8 is a perspective view of a door stop position control apparatus according to the present invention.

The door stop position control apparatus will be explained in detail with reference to FIG. 8. This door stop position control apparatus is mounted on the frame 15. The motion of the roller chain 3 is transmitted into the door stop position control apparatus by a pinion 29 in mesh with a pulley rack 28 synchronous with the roller chain 3. On the basis of the amount of movement or motion of the roller chain transmitted to the pinion 29, the upper and lower limit switches 30 and 31 are controlled through a worm 51. First, the operation of the lower limit switch 31 will be explained. Under the condition where this switch is not set, the lower limit adjust lever 33 is normally pressed in the direction of the arrow and supported by a lock mechanism (not shown). Under this condition, a lower limit gear shaft 56 is urged in the X direction against the holding spring 58 by the tapered portion of the lower limit adjust lever 33, so that the gear (a) 59 which otherwise would be in mesh with the worm 51 is disengaged therefrom. Further, the gear (b) 63 integral with the gear (a) 59 which otherwise might be in mesh with the gear (c) 62 integral with the lower limit cam plate 60 is disengaged therefrom, so that the worm 51 is rotatable freely of the engagement with these gears. The lower limit cam plate 60 integral with the gear (c) 62 is rotated in direction A on the shaft 64 by a coil spring 65 interposed on the shaft 64 between the lower limit cam plate 60 and the gear (c) 62, and is thus returned to the stop position thereof. In order to actuate the lower limit switch 31 at this stop position, the lower limit cam plate 60 is provided with a recess. To the extent that the lower limit adjust lever 33 is pressed, however, the end of the lower limit adjust lever 33 presses up the lower limit switch 31 in opposite direction, and therefore the lower limit switch 31 fails to be actuated even at the stop position of the lower limit cam plate 60. In setting a lower limit door stop position, it is necessary to make sure that the lower limit adjust lever 33 is pressed up, and then the motor 16 is driven by the push button switch 12, thus moving the door in the closing direction. Namely, the pulley rack 28 is rotated in direction A. Under this condition, the transmission gearing to the lower limit switch 31 is disengaged and therefore fails to rotate as mentioned above. Assume that the door is stopped by turning off the push button switch 12 at the desired position while watching the door movement, the locked condition of the lower limit adjust lever 33 released, and that the lever 33 is pulled back in the direction opposite to the arrow into the condition shown in the drawing. Then the lower limit switch 31 comes to an operating position. At the same time, the holding spring 58 urges the lower limit gear shaft 56 in direction Y, so that the transmission gearing is engaged, and the chain is coupled with the lower limit cam plate 60. Now, the lower limit door stop position is set. In setting the upper limit door stop position, after confirming that the upper limit adjust lever 32 is pressed up as in the case of the lower limit switch, the door is driven in opening direction, followed by the same procedures as in setting the lower limit. In this case, the lower limit switch 31 operates in such a manner that in view of the fact that the door is driven in opening direction, namely, the pulley rack 28 rotates in direction B, the transmission through the gearing causes the lower cam plate 60 to rotate in direction B against the coil spring 65. At the upper limit position, the door is stopped, and the upper limit switch 30 is set, followed by the switch ordering the door to be closed. The pulley rack 28 rotates in direction A, and the lower cam plate 60 also rotates in direction A through the engagement of the transmission gearing. When the lower cam plate 60 rotates to the above-mentioned set position, the lower limit switch 31 is actuated, thus stopping the motor 16. The gear ratios are of course set in such a manner that the cam plates 60 and 61 make about one revolution by the maximum amount of movement of the roller chain. As mentioned above, the door stop position can be set easily only by operation of the adjust lever externally of the body. Also, the fact that confirming the locked condition of the upper and lower limit operating levers, the door is stopped by the switch at the desired position followed by unlocking facilitates the setting without any need of complicated setting work which otherwise might be required at a high position.

Figure 9:
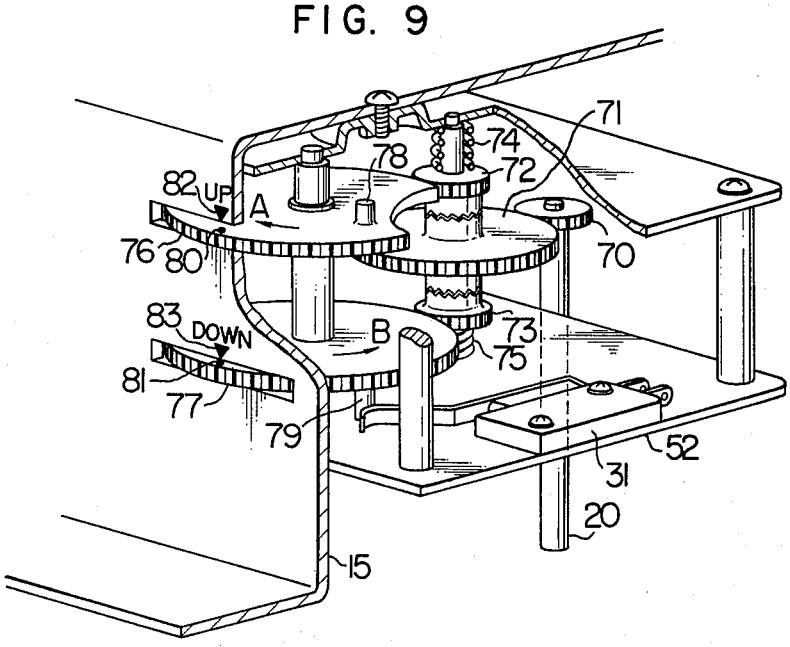
FIG. 9 is a perspective view showing the essential parts of a door stop position control apparatus according to another embodiment.
Figure 10:
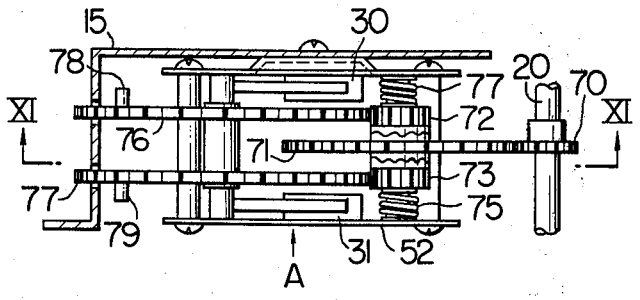
FIG. 10 is a side view thereof.
Figure 11:
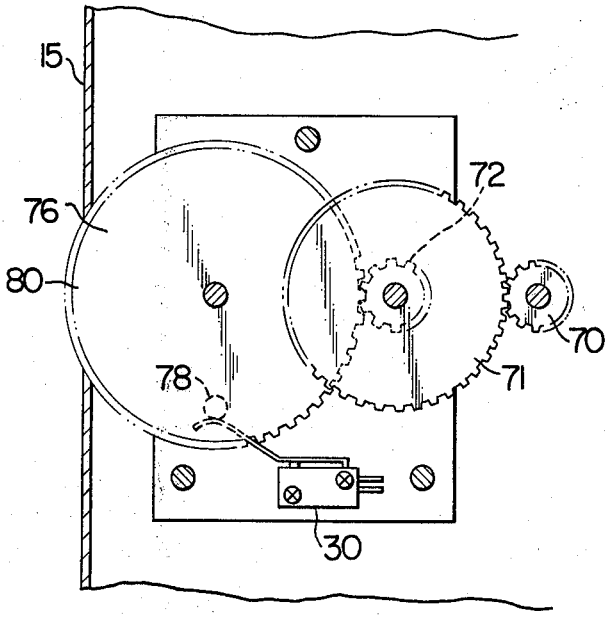
FIG. 11 is a sectional view taken in line XI—XI of FIG. 10.

Another embodiment of the present invention will be described with reference to FIGS. 9, 10 and 11. A perspective view is shown in FIG. 9, a sectional view of the apparatus of FIG. 9 is shown in FIG. 10, and a sectional view taken along line XI—XI in FIG. 10 is shown in FIG. 11. The amount of movement of the roller chain is transmitted to the input gear 71 of the door stop position control apparatus 52 through a gear 70 provided on the sprocket shaft 20 for driving the roller chain. The input gear 71 has grooves on both sides thereof, which are adapted to engage the groove formed in the upper and lower limit clutch gears 72 and 73. The clutch gears 72 and 73 are coupled with the input gear 71 by being pressed by the springs 74 and 75 respectively. The upper and lower limit clutch gears 72 and 73 are coupled with the upper dial gear 76 and the lower dial gear 77 respectively. The dial gears 76 and 77 are provided with strikers 78 and 79 respectively and also with marks 80 and 81 respectively. When the marks 80 and 81 of the dial gears 76 and 77 come to match with the marks 82 and 83 of the frame 15, the strikers 78 and 79 for the dial gears 76 and 77 actuate the limit switches 30 and 31. The gear ratio of the gears is set in such a manner that one revolution of the dial gears 76 and 77 represents the maximum amount of movement of the roller chain. Also, the form of the grooves of the input gear 71 and the clutch gears 72 and 73 and the power of the springs 74 and 75 are so determined that a sufficient amount of torque to drive the dial gears 76 and 77 is transmitted from the sprocket shaft 20 and if a torque larger than that is applied, the clutch gears are moved in the direction of the arrow A of FIG. 10 against the power of springs thereby to disengage the transmission. For this reason, in the case where the turning effort is applied in opposite direction, namely, from the dial gears 76 and 77, the large load of the sprocket shaft 20 connected with the roller chain and the door causes the clutch gears 72 and 73 to disengage, with the result that the dial gears 76 and 77 are rotatable independently of the driving system. In setting the door stop position, the dial gears are displaced slightly from the marks in opposite direction in advance. After driving and stopping the door at a given position, the dial gears 76 and 77 are manually rotated to the marks, thus completing the setting work. Depending on the positions of the dial gears 76 and 77, they may come to the positions of the marks resulting in the switches 30 and 31 being actuated thereby to stop the door. In order to prevent such an inconvenience, the dial gears 76 and 77 are required to be displaced in advance of setting as mentioned above to enable about one rotation thereof in maximum. If this operation is troublesome, an on-off switch is inserted in an electrical circuit line common to the upper and lower limit switches 30 and 31, so that this switch is turned off during the setting process and then turned on with the marks set after stopping the door at the desired position.

Figure 12:
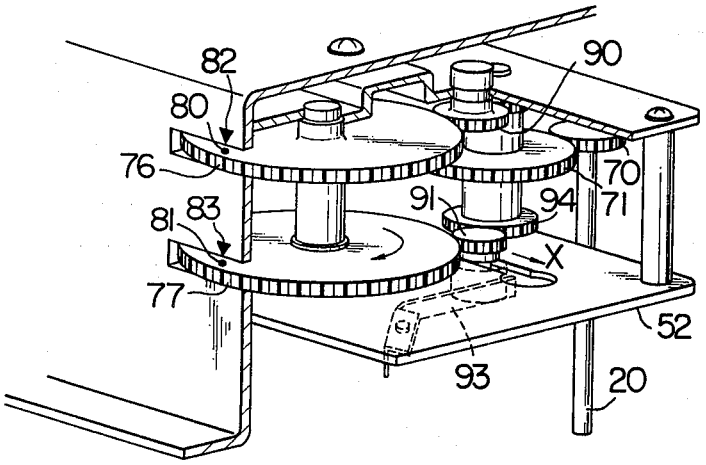
FIGS. 12 and 13 are perspective views of the essential parts of a door stop position control apparatus according to still other embodiments.

Still another embodiment of the present invention is shown in FIG. 12. This embodiment is substantially the same as the embodiment of FIG. 9, the only difference being that in the embodiment of FIG. 12, disengagement of transmission is effected at movable intermediate gears 90 and 91. When the dial gears 76 and 77 are rotated in the direction of arrow, the large load of the transmission system after the input gear 71 causes the movable intermediate gears 90 and 91 to move in direction X against the bias force of the holding springs 92 (not shown) and 93, so that the transmission engagement is released and the dial gears 76 and 77 are capable of rotating independently of the driving system.

Figure 13:
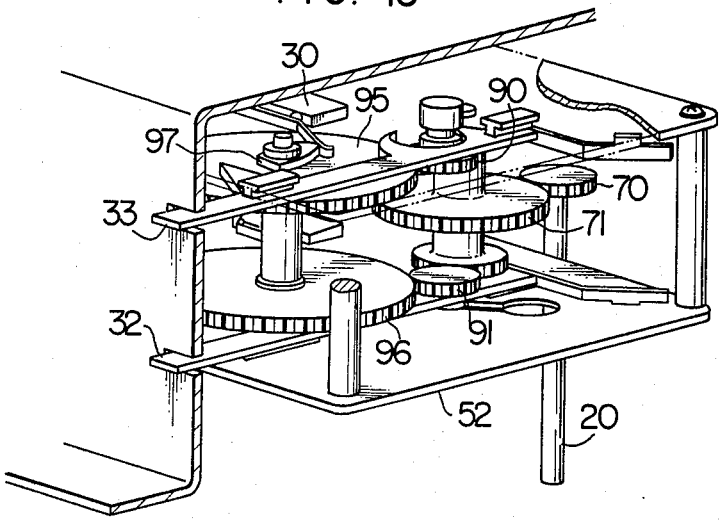
Figure 14:
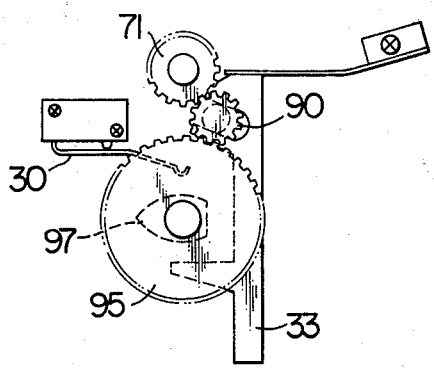
FIGS. 14 and 15 are plan views showing the operating conditions of the embodiment of FIG. 13.
Figure 15:
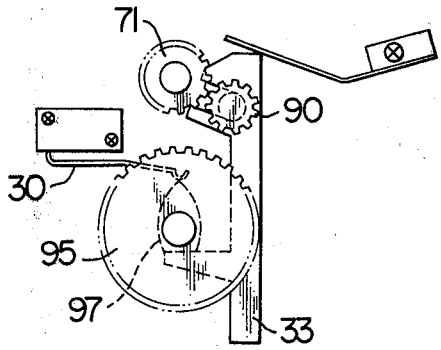

A still another embodiment of the present invention is shown in FIG. 13. The operation parts of the embodiment of FIG. 13 are shown in FIGS. 14 and 15. By depressing the adjust levers 32 and 33, the movable intermediate gears 90 and 91 are disengaged while at the same time restoring the limit switches 30 and 31 to an operating position by the form of the cams 97 and 98 provided on the large gears 95 and 96.

The present invention has been explained above with reference to a few embodiments. It is obvious that the transmission may be disengaged with equal effect by appropriate another means, such as a carry-up type mechanical counter switch. Also, the foregoing description refers to a trolley drive system using a roller chain, which may of course be replaced by a screw drive system, a wire drive system or other appropriate system with equal effect.

It will be understood from the foregoing description that according to the present invention a door stop position is easily set while at the same time improving the mountability and usability remarkably without using any special tool or means. Further, in view of the fact that there is no need to gain direct access to the driving system, safety is improved. Furthermore, the amount and nature of the work at a high place are changed favorably, thus reducing the danger of the work at high place which otherwise might occur in conventional control apparatuses.

What is claimed is:

1. In a garage door operation control apparatus having a driving system including a motor for operating the door between open and closed positions, a door stop position control system comprising: a switch operating member connected to said driving system through a transmission means so as to be moved in proportion to the amount of operation of said driving system, and a door stop switch operated at a predetermined door stop position in response to said switch operating member, said transmission means including means for releasing the interlocked relation between said driving system and said switch operating member, and said switch operating member being supported in such a manner as to be movable to a position actuating said door stop switch under the condition where the interlocked relation between said driving system and said switch operating member is released.

2. A garage door operation control apparatus according to claim 1, wherein said switch operating member is a rotary plate which, when released from the interlocked relation with said driving system, is connected with a spring for exerting a turning effort on said switch operating member thereby to rotate said switch operating member to a position actuating said door stop switch.

3. In a garage door operation control apparatus having a driving system including a motor for operating the door between open and closed positions, a door stop position control system comprising: a switch operating member connected to said driving system through transmission means so as to be moved in proportion to the amount of operation of said driving system, a door stop switch actuated at a predetermined door stop position by said switch operating member, and a frame for housing said parts, wherein said transmission means includes means for releasing the interlocked relation between said driving system and said switch operating member, said control apparatus further comprising an adjust lever for releasing the interlocked relation between said switch operating member and said driving system, said adjust lever acting on said releasing means and said switch operating member thereby to move said switch operating member to a switch actuating position.

4. A garage door operation control apparatus according to claim 3, wherein said switch operating member is a rotary plate supported in such a manner as to be rotated by said adjust lever to said set position for actuating said door stop switch when the interlocked relation between said switch operating member and said driving system is released.

5. A garage door operation control apparatus according to claim 3, wherein said adjust lever is located outside of said frame.

6. In a garage door operation control apparatus having a driving system including a motor for operating the door between open and closed positions, a door stop position control system comprising:

a door stop switch electrically connected in circuit with said motor for stopping the operation of said motor upon actuation;

a switch operating member for actuating said door stop switch at a predetermined door stop position; and transmission means for interconnecting said switch operating member to said driving system so that said switch operating member is moved in proportion to the movement of said door by said driving system, including means for releasing the interconnecting relationship between said driving system and said switch operating member and setting means responsive to operation of said releasing means for moving said switch operating member to a position actuating said door stop switch.

7. A garage door operation control apparatus according to claim 6, wherein said switch operating member is a rotary cam plate, and said setting means comprises a spring member connected to said cam plate and operable to rotate said cam plate to said switch actuating position when said cam plate is released from said driving system.

8. In a garage door operation control apparatus having a driving system including a motor for operating the door between open and closed positions, a door stop position control system comprising:

a door stop switch electrically connected in circuit with said motor for stopping the operation of said motor upon actuation;

a switch operating member for actuating said door stop switch at a predetermined door stop position; and transmission means for interconnecting said switch operating member to said driving system so that said switch operating member is moved in proportion to the movement of said door by said driving system, including means for permitting selective movement of said switch operating member independently of said driving system to a position actuating said door stop switch to effect a position setting of said switch operating member.

9. A garage door operation control apparatus according to claim 8, wherein said transmission means includes a drive gear driven by said driving system for coordinate movement therewith, an input gear in engagement with said drive gear, and a clutch gear in driving engagement with said switch operating member and connected to said input gear by way of a clutch connection shaft for permitting movement of said switch operating member independently of said driving system.

10. A garage door operation control apparatus according to claim 8, wherein said transmission means includes a drive gear driven by said driving system for coordinate movement therewith, an input gear in engagement with said drive gear, a clutch gear supported on a common shaft with said input gear, an intermediate gear mounted for movement between a first position in engagement with both said clutch gear and said switch operating member and a second position in engagement only with said clutch gear, and bias means for biasing said intermediate gear toward said first position.

* * * * *